US005996511A

United States Patent [19]

Swoger

[11] Patent Number: 5,996,511

[45] Date of Patent: Dec. 7, 1999

[54] TRAY DEVICE FOR ATTACHMENT TO A VERTICAL POLE

[76] Inventor: Gary J. Swoger, 209 Garth Rd., Oreland, Pa. 19075-1907

[21] Appl. No.: 09/020,640

[22] Filed: Feb. 9, 1998

[51] Int. Cl.[6] ..... A47B 47/00

[52] U.S. Cl. ..... 108/157.13; 211/107; 211/88.01; 108/28; 108/50.12; 108/151

[58] Field of Search ..... 135/16, 15.1; 248/219.4, 248/218.4; 211/107, 50, 88.01; 108/25, 28, 50.12, 147.18, 150, 151, 157.13, 157.17, 158.11, 158.13, 29, 30, 92, 93, 101; 403/373, 13

[56] References Cited

U.S. PATENT DOCUMENTS

| | | | |
|---|---|---|---|
| D. 291,635 | 9/1987 | Dickman . | |
| 1,136,129 | 4/1915 | Haskell | 108/28 X |
| 1,799,079 | 3/1931 | Bemis . | |
| 2,221,366 | 11/1940 | Bisbing et al. . | |
| 2,242,150 | 5/1941 | Sievers | 108/28 X |
| 2,743,146 | 4/1956 | Wheeler | 108/50.12 |
| 3,194,403 | 7/1965 | Van Horn, Jr. . | |
| 3,223,467 | 12/1965 | Jafelice | 248/219.4 X |
| 3,414,133 | 12/1968 | Guerri et al. . | |
| 3,449,002 | 6/1969 | Bernard | 211/107 X |
| 3,620,174 | 11/1971 | Dentino | 108/151 |
| 4,678,089 | 7/1987 | Lang . | |
| 4,679,509 | 7/1987 | Sampson, Jr. | 108/27 |
| 4,708,256 | 11/1987 | Intardonato . | |
| 4,925,144 | 5/1990 | White | 248/445 |
| 4,953,716 | 9/1990 | Rapoport | 211/107 |
| 5,114,023 | 5/1992 | Lavin . | |
| 5,493,976 | 2/1996 | Hammond . | |

*Primary Examiner*—Janet M. Wilkens
*Attorney, Agent, or Firm*—LaMorte & Associates

[57] ABSTRACT

A support device that attaches to a vertical pole so that objects can be supported along the length of a vertical pole. The support device includes a platform that has a midpoint and a peripheral edge. The platform defines a slot that extends from the peripheral edge to the midpoint, wherein the slot has a width at least as wide as the vertical pole onto which the platform attaches. A clamp element is selectively positionable within the slot. A bias mechanism is provided for biasing the clamp element into the slot toward the midpoint of the platform. A napkin holding mechanism is also provided. The napkin holding mechanism extends below the platform and holds napkins in a manner that enables single napkins to be readily removed as needed.

19 Claims, 5 Drawing Sheets

TRAY DEVICE FOR ATTACHMENT TO A VERTICAL POLE

BACKGROUND OF THE INVENTION

1. Field of the Invention

The present invention relates to containers, receptacles and the like that are adapted to be attached to a vertical pole, thereby providing a place to store or hold objects on the vertical pole. More particularly, the present invention relates to containers and receptacles that can be attached to any point along the length of a vertical pole.

2. Description of the Prior Art

Shade umbrellas are very common in recreational settings. For instance, people often bring umbrellas to the beach to shade the sun. Similarly, many picnic tables and patio tables have holes in their centers to retain a shade umbrella. The umbrella can therefore be used to shade the food on the table and the people eating around the table.

Vertical poles are the support of choice in supporting umbrellas. Vertical poles support the canopy of the umbrella overhead in a manner that is not highly obtrusive. The vertical pole of an umbrella commonly extends to the center of the canopy so that the canopy is balanced around the top of the pole. The canopy of most shade umbrellas is typically less than six feet in diameter. As a result any person sitting under the canopy of the shade umbrella would be within arms length of the vertical pole supporting the umbrella.

Since the vertical pole of a beach umbrella is within arms reach of a person under the beach umbrella, it would be convenient if the umbrella's vertical pole could be utilized for some secondary purpose. One such secondary purpose is that of an object support. People sitting at the beach have many objects that they do not wish to set into the sand. Such objects extend from jewelry that may get lost in the sand to food that can be contaminated with sand. Recognizing the need to hold objects above the sand, various receptacles have been invented that are intended to attach to an umbrellas pole so as to provide an elevated place to store objects. Such prior art devices are exemplified by U.S. Pat. No. 3,414,133 to Guerri, entitled Small Hanging Basket For Beach Umbrellas and U.S. Pat. No. Des 291,635 to Dickman, entitled Portable Tray For Attachment To A Beach Umbrella. In both the cited references, a receptacle is attached to the pole of an umbrella using a tube clamp that passes around the umbrella pole and a set key that passes through the tube clamp and tightens against the umbrella pole.

The prior art devices that use a tube clamp to engage a vertical pole have disadvantages. First, in order to move the tube clamp into position on the vertical pole, the tube clamp must be advanced over one end of the vertical pole. In many circumstances, this can not be done. For instance, if a shade umbrella has a support stand connected to its bottom and the umbrella's canopy is at the top, prior art supports that must slide along the umbrella pole cannot be used. Similarly, if the umbrella contains a hinge, a canopy lock or some other object that enlarges the diameter of the umbrella pole, prior art devices that use tube clamps also cannot be used.

Another disadvantage of prior art devices that use tube clamps is the poor holding strength provided by the tube clamp. Many shade umbrellas have poles that are made from thin metal tubing. If a prior art device with a tube clamp were used, the tube clamp can only be tightened a predetermined threshold amount before the locking key of the tube clamp would deform the umbrella pole. Since the tube clamp can only be tightened to a limited amount, the tube clamp only produces a limited degree of engagement with the umbrella pole. Consequently, prior art devices that use tube clamps are prone to slippage.

Yet another disadvantage of prior art devices that use tube clamps is that the tube clamp only works well on poles that have a diameter similar to that of the aperture in the tube clamp. If the pole is wider than the tube clamp aperture, then the tube clamp cannot be used. If the aperture of the tube clamp is much larger than that of the pole, then the tube clamp will not hold well and the tube clamp may cock to one side.

A need therefore exists in the art for a receptacle that is adapted to attach to a vertical pole at any point between the ends of the pole without having to slide along the pole from one of the ends. A need also exists for a receptacle that is capable of firmly attaching to any pole within a range of diameters without harm to that pole.

These needs are met by the present invention as described and claimed below.

SUMMARY OF THE INVENTION

The present invention is a support device that attaches to a vertical pole so that objects can be supported along the length of a vertical pole. The support device includes a platform that has a midpoint and a peripheral edge. The platform defines a slot that extends from the peripheral edge to the midpoint, wherein the slot has a width at least as wide as the vertical pole onto which the platform attaches. A clamp element is selectively positionable within the slot. A bias mechanism is provided for biasing the clamp element into the slot toward the midpoint of the platform. The bias mechanism includes a screw plate that extends across the slot and a screw that extends through the screw plate and engages the clamp element. A handle is affixed to the screw thereby providing a means for turning the screw and advancing the screw through said screw plate.

The present invention support device also includes a napkin holding mechanism that extends below the platform. The napkin holding mechanism holds napkins in a manner that prevents them from being blown away by the wind, However, the napkin holding mechanism enables single napkins to be readily removed as needed.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE INVENTION

Although the present invention device can be attached to many types of vertical objects, such as small trees, fence rails and the like, the present invention device is especially well suited for use in attaching to the vertical shaft of a shade umbrella. Consequently, by way of example, the present invention will be described in an application where it attaches to the vertical shaft of a shade umbrella in order to set forth the best mode contemplated for the device.

Figure 1:
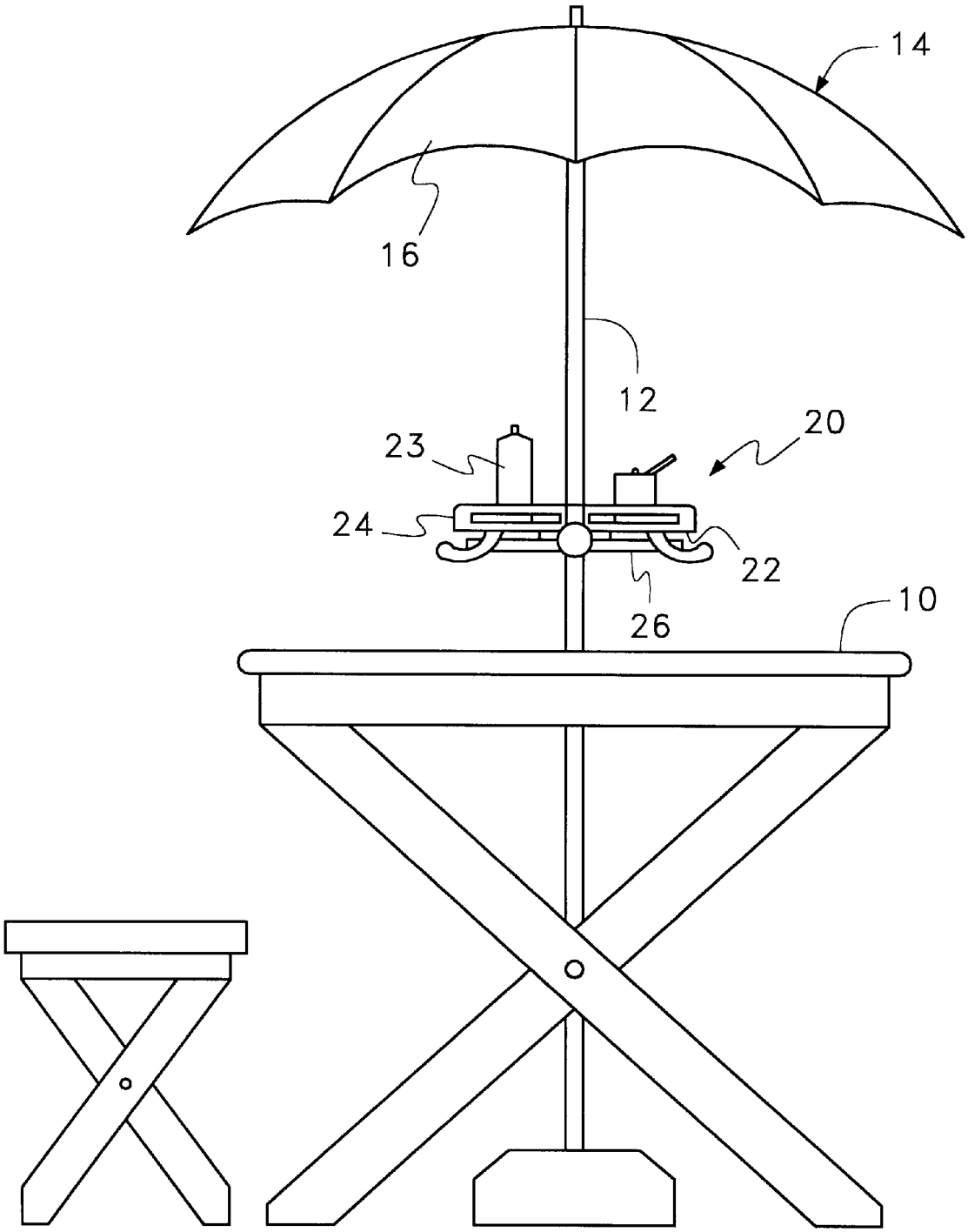
FIG. 1 is a front view of the an exemplary embodiment of the present invention device shown in conjunction with an umbrella and a picnic table.

Referring to FIG. 1, a picnic table 10 is shown. The picnic table 10 has a hole in its center through which the vertical shaft 12 of a shade umbrella 14 passes. The picnic table 10 helps support the shade umbrella 14 so that the canopy 16 of the umbrella 14 casts shade across the picnic table 10. Such table/umbrella configurations are commonplace in backyards, picnic grounds and outdoor cafes.

In FIG. 1, a first preferred embodiment of the present invention support device 20 is also shown. The support device 20 attaches to the vertical shaft 12 of the umbrella 16 in a manner which will later be described. The support device 20 provides a horizontal platform 22 upon which objects can be placed. In the shown embodiment, the support device 20 is used to hold lunch condiments 23, such as ketchup, mustard and relish, which would be commonly used at a picnic. The condiments 23 rest on the horizontal platform 22. A rail element 24 is present around the periphery of the horizontal platform 22 to prevent the condiments 23 from inadvertently falling off of the horizontal platform 22.

Also shown in FIG. 1 is a napkin holding mechanism 26 that extends below the horizontal platform 22. The napkin holding mechanism 26 retains a plurality of napkins on either side of the umbrella's shaft 12. The napkins are accessible for the taking but are retained in a manner that prevents the napkins from blowing away in a breeze. The details of the napkin holding mechanism 26 will be later described in detail with the description of FIG. 4.

Figure 2:
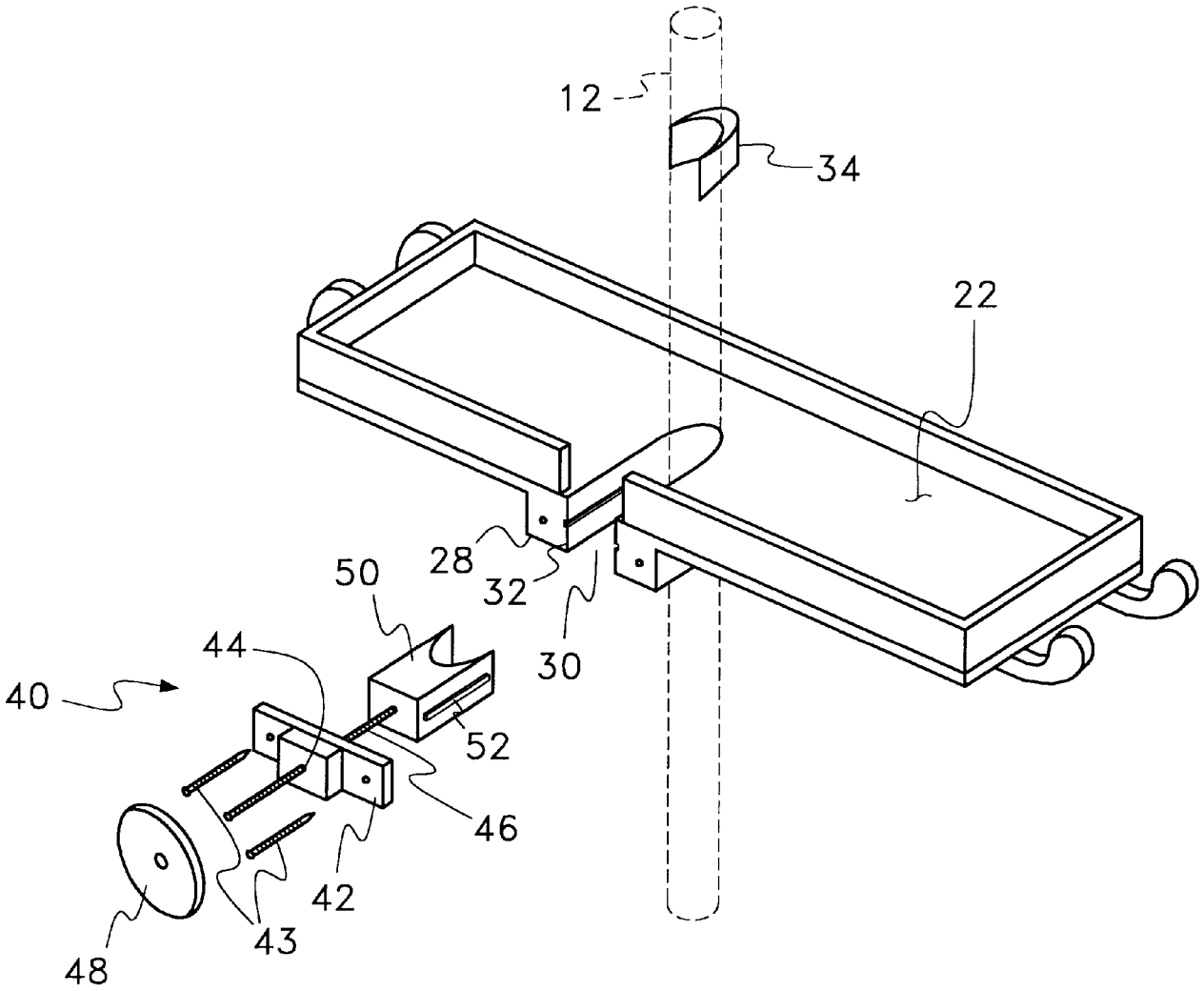
FIG. 2 is an exploded perspective view of the embodiment of the present invention device shown in FIG. 1.

Referring to FIG. 2, it can be seen that a support block 28 is affixed to the bottom of the horizontal platform 22 in its middle. The support block 28 can be either unistructurally formed as part of the horizontal platform 22 or rigidly affixed to the bottom of the horizontal platform 22. A lateral slot 30 is formed through both the horizontal platform 22 and the below lying support block 28. The lateral slot 30 is open at one end, wherein the center of the open end of the slot 30 is midway between the ends of the horizontal platform 22. The width of the slot 30 is preferably between 2 cm and 5 cm with a preferred width of approximately 3.5 cm. Guide grooves 32 are disposed in the walls of the support block 28 facing the lateral slot 30. The purpose of the guide grooves 32 is later explained.

The lateral slot 30 extends laterally across the horizontal platform 22. The back end of the slot 30 is semicircular having a radius of curvature that is equal to half the width of the slot 30. The center of the radius of curvature of the back of the slot 30 corresponds in position to the physical center of the horizontal platform 22.

To attach the horizontal platform 22 to a vertical pole 12, the vertical pole 12 is advanced into the lateral slot 30. The pole 12 abuts against the curved rear of the slot 30. Accordingly, the center of the vertical pole 12 should generally align with the physical center of the horizontal platform 22. If the diameter of the pole 12 is significantly smaller than the width of the lateral slot 30, a spacer 34 can be used. The spacer 34 is crescent in shape, having an inside diameter that matches the vertical pole 12 and an outside diameter that matches the curved back end of the lateral slot 30.

In FIG. 2, it can be seen that the vertical shaft 12 is retained in the lateral slot 30 by a clamping assembly 40. The clamping assembly includes a screw plate 42 that attaches to the support block 28 on either side of the lateral slot 30. In the shown embodiment, two screws 43 are used to attach the screw plate 42 to the support block 28. However, it will be understood that other attachment mechanisms can also be used. The screw plate 42 has a central aperture 44 that is threaded. A screw shaft 46 passes through the central aperture 44 in the screw plate 42. On one side of the screw plate 42, the screw shaft 46 terminates with a handle 48. As a result, it will be understood that as the handle 48 is turned the screw shaft 46 turns and the screw shaft 46 moves in relation to the screw plate 42. The opposite end of the screw shaft 46 terminates with clamping head 50. The clamping head 50 engages the screw shaft 46 but is not rigidly affixed to the screw shaft 46. Accordingly, the screw shaft 46 is free to rotate independently of the clamping head 50. The front of the clamping head 50 contains a semicircular recess. The radius of curvature for the semicircular recess is preferably the same as that of the rear of the lateral slot 30. Guide keys 52 extend from the sides of the clamping head 50. The guide keys 52 pass into the guide grooves 32 located in the sides of the support block 28. The presence of the guide keys 52 in the guide grooves 32 ensures that the clamping head 50 will only move back and forth along the length of the lateral slot 30 when forces are applied to the clamping head 50.

Figure 3:
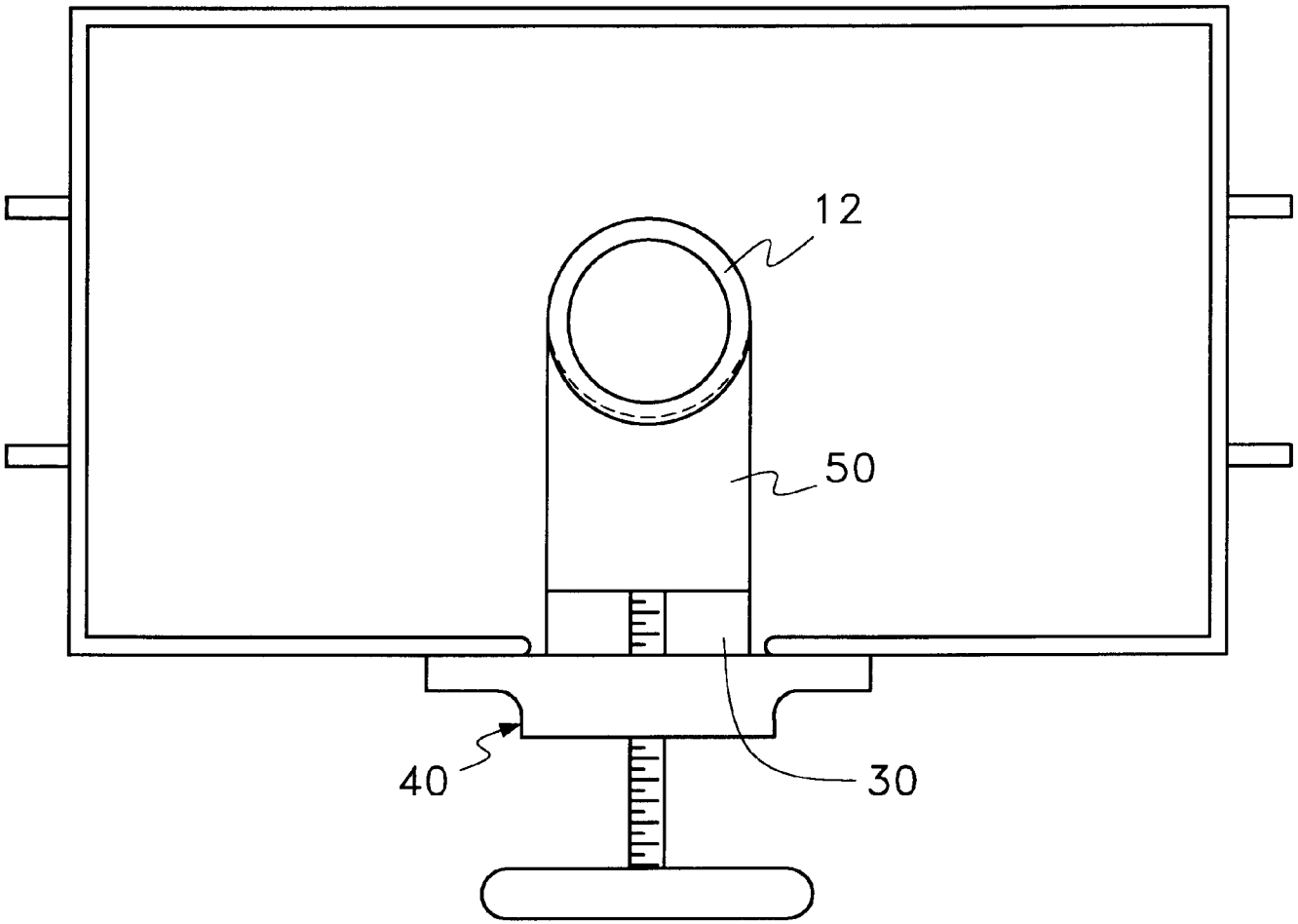
FIG. 3 is a top view of the embodiment of the present invention shown in FIG. 2.

Referring to FIG. 3. it can be seen that when the clamping assembly 40 is set in place, the clamping head can be advanced into the lateral slot 30 until the clamping head engages the vertical shaft 12. As the clamping head 50 engages the vertical shaft 12, the clamping head 50 compress the vertical shaft 12 between the back of the lateral slot 30 and the advancing clamping head 50. Since both the clamping head 50 and the back of the lateral slot 30 are curved, a large area of contact occurs between the vertical shaft 12 and the compressing elements. This enables a strong clamping force to be applied to the vertical shaft 12 without causing damage to the vertical shaft 12.

Figure 4:
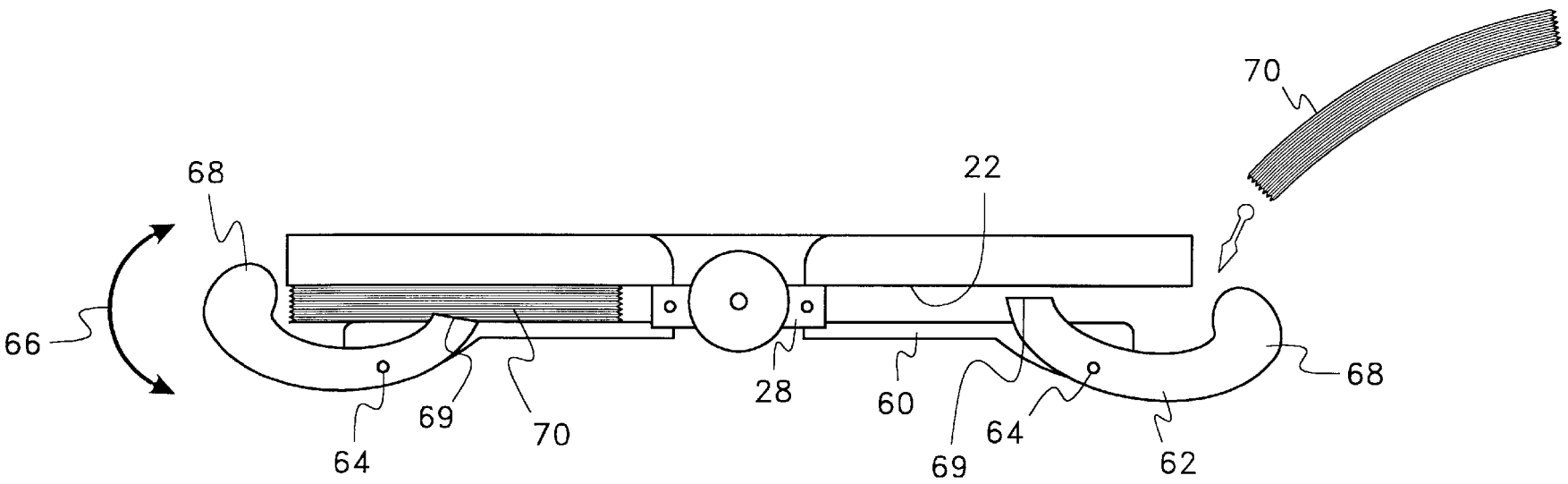
FIG. 4 is a side view of the exemplary embodiment of the present invention shown in conjunction with napkins.
Figure 5:
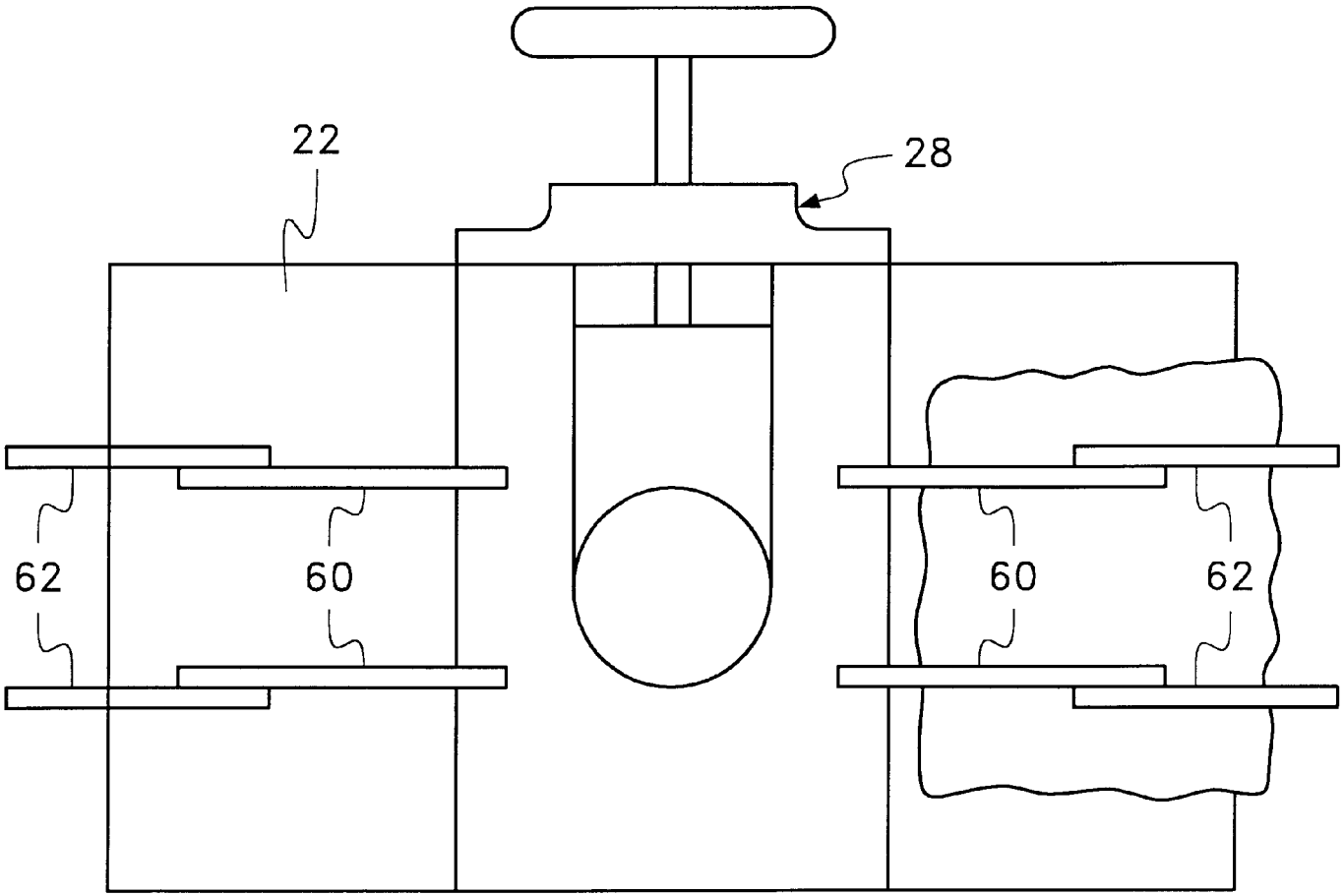
FIG. 5 is a bottom view of the embodiment of the present invention shown in FIG. 4.

Referring to FIG. 4 in conjunction with FIG. 5, the structure of the napkin holding mechanism can be explained. Two lateral arms 60 extend from either side of the support block 28 under the horizontal platform 22. The lateral arms 60 are parallel to each other and are also parallel to the horizontal platform 22. The lateral arms 60 are preferably between 3 inches and 8 inches in length and the space between the lateral arms is preferably between 1.5 inches and 4 inches.

Lever elements 62 are disposed at the ends of each of the lateral arms 60. As is shown in FIG. 4, the lever elements 62 are coupled to the lateral arms 60 by pivots 64. The pivots 64 enable the lever elements 60 to rotate relative to the lateral arms 60 in the directions of arrow 66. The lever elements 62 are curved. At one end of the lever elements 62 is an enlarged area 68. The enlarged area 68 makes the lever element 62 heavier on one side of the pivot 64 than on the other side. Consequently, the enlarged area 68 caused the opposite end 69 of the lever element to rotate upwardly and be biased against the horizontal platform 22.

To place napkins 70 in the napkin holding mechanism, a stack of napkins is advanced over the lever elements 62 and onto the lateral arms 60. The presence of the napkins 70 causes the lever elements 62 to rotate out of the way. However, the first end 69 of the lever elements 62 is still biased upwardly against the bottom of the napkins 70. The bias of the lever elements 62 against the napkins 70 compresses the napkins 70, thereby preventing the napkins 70 from falling out of place or being blown away by the wind.

To remove a napkin 70, a single napkin 70 is grasped from below between the lateral arms 60. The napkin can then be pulled downwardly and away from the device.

It will be understood that a person skilled in the art could make alternate embodiments of the present invention using functionally equivalent components that have not been specifically described. For example, the size and shape of the horizontal platform can be altered as desired. All such obvious modifications are intended to be included in the scope of this disclosure as defined by the appended claims.

What is claimed is:

1. A tray assembly for attaching to a vertical pole, comprising:

a platform having a center point and a peripheral edge, said platform defining a slot that extends from an open end at said peripheral edge to a curved closed end at said center point;

a removable plate attached to said platform across said open end of said slot, wherein a threaded aperture extends through said removable plate;

a clamp element selectively positionable in said slot between said curved closed end and said removable plate, wherein said clamp element is movable back and forth within said slot;

a threaded shaft having a first end and a second end, said threaded shaft extending through said threaded aperture in said removable plate, wherein said first end of said threaded shaft engages said clamp element and moves said clamp element back and forth in said slot as said threaded shaft is selectively rotated in opposite directions; and a handle disposed at the second end of said threaded shaft to facilitate the manual turning of the threaded shaft.

2. The assembly according to claim 1, wherein said curved closed end of said slot terminates proximate said center point of said platform with a predetermined radius of curvature.

3. The assembly according to claim 2, wherein the center of said predetermined radius of curvature corresponds in position to said center point of said platform.

4. The assembly according to claim 2, wherein said clamp element has a curved face surface with a a radius of curvature that is generally equal to said predetermined radius of curvature present on said curved closed end of said slot.

5. The assembly according to claim 1, wherein said slot has side walls and a guide groove is disposed in each of said side walls.

6. The assembly according to claim 5, wherein said clamp element includes guides that ride in said guide grooves when said clamp element is in said slot.

7. The assembly according to claim 1, further including a rail element extending upwardly from said peripheral edge of said platform.

8. The assembly according to claim 1, at least one napkin holding mechanism affixed to said platform.

9. The assembly according to claim 8, wherein said napkin holding mechanism includes two lateral arms supported a predetermined distance below said platform, wherein a space exists between said lateral arms and said platform that is large enough to retain a stack of napkins.

10. The assembly according to claim 9, wherein said napkin holding mechanism further includes a lever element pivotably coupled to the end of each of said lateral arms.

11. The assembly according to claim 10, wherein each said lever element has a first end and a second end, wherein each said lever element is attached via a pivot to one of the lateral arms at a point between said first end and said second end.

12. The assembly according to claim 11, wherein each said lever element is heavier on one side of said pivot than on the other side, thereby causing said first end of said lever element to be biased into the space between said platform and said lateral arms.

13. A napkin holding device, comprising:

a planar element having a peripheral edge;

an attachment mechanism for attaching said planar element to a vertical pole;

two lateral arms supported a predetermined distance below said planar element, wherein a space exists between said lateral arms and said planar element that is large enough to retain a stack of napkins;

a lever element pivotably coupled to each of said lateral arms, wherein each said lever element has a first end and a second end and each said lever element is attached via a pivot to one of the lateral arms at a point between said first end and said second end;

wherein each said lever element is heavier on one side of said pivot than on the other side and causes said first end of said lever element to be biased into the space between said planar element and said lateral arms.

14. The device according to claim 13, further including a rail element extending upwardly from said peripheral edge of said planar element.

15. The device according to claim 13 wherein said planar element includes a midpoint, said planar element defining a slot that extends from said peripheral edge to said midpoint.

16. The device according to claim 15, wherein said attachment mechanism includes a clamp element selectively positionable in said slot wherein said clamp element is movable back and forth within said slot; and a bias mechanism for biasing said clamp element into said slot toward said midpoint.

17. The device according to claim 16, wherein said bias mechanism includes a screw plate that extends across said slot and a screw that extends through said screw plate and engages said clamp element.

18. The device according to claim 17, further including a handle affixed to said screw thereby providing a means for turning said screw and advancing said screw through said screw plate.

19. A device for attaching to a vertical pole, comprising:

a platform having a midpoint and a peripheral edge, said platform defining a slot that extends from said peripheral edge to said midpoint;

a clamp element selectively positionable in said slot wherein said clamp element is movable back and forth within said slot; and a bias mechanism for biasing said clamp element into said slot toward said midpoint of said platform.

* * * * *